US011258180B2

(12) United States Patent
Schultz

(10) Patent No.: US 11,258,180 B2
(45) Date of Patent: Feb. 22, 2022

(54) FOIL ANTENNA

(71) Applicant: FUBA Automotive Electronics GmbH, Bad Salzdetfurth (DE)

(72) Inventor: Micha Schultz, Bad Salzdetfurth (DE)

(73) Assignee: FUBA Automotive Electronics GmbH

( * ) Notice: Subject to any disclaimer, the term of this patent is extended or adjusted under 35 U.S.C. 154(b) by 296 days.

(21) Appl. No.: 16/661,621

(22) Filed: Oct. 23, 2019

(65) Prior Publication Data

US 2020/0136259 A1 Apr. 30, 2020

(30) Foreign Application Priority Data

Oct. 23, 2018 (DE) ..... 102018126361.9

(51) Int. Cl.
*H01Q 9/28* (2006.01)
*H01Q 1/32* (2006.01)

(52) U.S. Cl.
CPC ..... *H01Q 9/285* (2013.01); *H01Q 1/32* (2013.01)

(58) Field of Classification Search
CPC ..... H01G 1/32; H01G 9/285
See application file for complete search history.

(56) References Cited

FOREIGN PATENT DOCUMENTS

| | | | |
|---|---|---|---|
| DE | 3306054 | A1 | 8/1984 |
| DE | 60007254 | T2 | 9/2004 |
| WO | 8908973 | A1 | 9/1989 |
| WO | 9624963 | A1 | 8/1996 |
| WO | 9629756 | A1 | 9/1996 |
| WO | 2004025778 | A1 | 3/2004 |
| WO | 2012118636 | A2 | 9/2012 |

OTHER PUBLICATIONS

Search Report regarding related DE Application No. 102018126361.9; dated Oct. 1, 2019; 9 pgs.

*Primary Examiner* — Graham P Smith
(74) *Attorney, Agent, or Firm* — Dickinson Wright PLLC

(57) ABSTRACT

A film antenna comprises an antenna element having a first electrically conductive layer and an adaptation network that is formed by a second conductive layer.

16 Claims, 2 Drawing Sheets

FOIL ANTENNA

CROSS-REFERENCES TO RELATED APPLICATIONS

Figure 1:
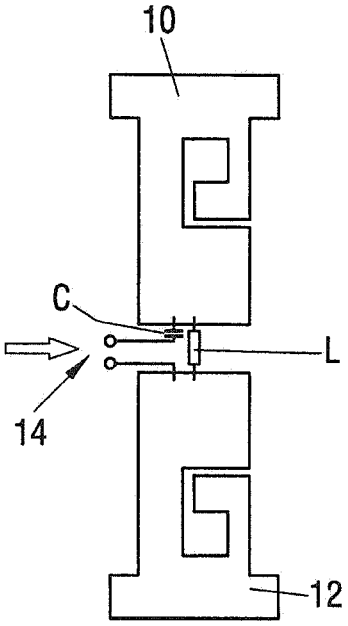

This patent application claims the priority of German Application No. 102018126361.9, filed Oct. 23, 2018 which is incorporated herein by reference in its entirety.

This invention relates to antennas, in particular for use in motor vehicles. A large number of antennas are installed in modern motor vehicles. This is necessary since a large number of services having different demands have to be covered. Antennas are, for example, required for the GNSS system (Global Navigation Satellite System) for positional determination that have a preferred direction toward the zenith in the antenna characteristics. In contrast to this, there are, for example, antennas for AM/FM, wireless LAN, C2X, or LTE whose preferred direction should be close to the horizon with an omnidirectional characteristic in the region of the horizontal plane.

In addition to standard roof antennas or roof antenna modules (shark fins) further installation sites are also additionally used. They can include mirrors, windows, bumpers, and further installation sites at and in a vehicle. Dipole antennas are in particular suitable for LTE and for a use in bumpers since they have omnidirectional characteristics when arranged vertically and since they do not require any ground relation. In comparison with a monopole, the antipole (that is the reference to ground) is implicitly implemented via the dipole branch in dipole antennas. It so-to-say represents a reduced ground plane.

A dipole does not require any contact (neither capacitively nor galvanically) to surrounding metal surfaces. It can thereby be used flexibly and can be implemented in compact form. It is equally possible to adapt and to implement this dipole as broadband or as a multiband antennal for all LTE bands. Such an antenna can additionally be implemented with only one film (e.g. consisting of a carrier film, a copper layer, and a top film). A cable then only has to be connected for connection to a transceiver.

The present invention preferably relates to such an LTE dipole antenna for use in motor vehicles. The principle described here is, however, also usable in all the application regions in which film antennas are used.

It is known that the bandwidth of antennas can be increased by means of adaptation networks or that the antenna size can be reduced with a comparable performance (adaptation, gain, efficiency). The smaller the antenna is, the more flexibly it can be used and the less expensively it can also be implemented since the film size is reduced and the capacity utilization is thus increased.

It is therefore the object of the invention to provide a film antenna that can be inexpensively manufactured with a high efficiency and a compact design.

This object is satisfied by the features of claim 1 and in particular by a film antenna that comprises at least one antenna element having an electrically conductive layer, with an adaptation network being provided that comprises at least one inductor and one capacitor. The capacitor is here formed by a second conductive layer that is folded over on itself along a fold line.

It is proposed in accordance with the invention to replace all the required discrete adaptation components (typically inductors and capacitors) by structures implemented in film. An inductor can be implemented by a conductor loop and a capacitor can be implemented by a further conductive layer, for example a copper layer. The second required surface of the capacitor can here be manufactured in accordance with the invention by stamping or cutting out and folding over from only one copper layer. No further copper layers are hereby required, which saves costs and process effort. The folded over conductive layer or film can be fixed either by an adhesive film between the layers, by a further top film or carrier film, or by laminating together. The otherwise discretely implemented adaptation components can thus be replaced with film implementations having an equivalent value without compromises having to be made in the effectivity of the adaptation network or in the antenna performance in general. Since in this case fewer or even no discrete components have to be mounted on the film, costs and standstill times are reduced. At the same time, the antenna can be made considerably smaller with respect to an implementation completely without an adaptation circuit with a comparable performance.

Advantageous embodiments of the invention are described in the description, in the drawing and in the dependent claims.

The antenna element can have a copper film or a copper layer as the electrically conductive layer, said copper film or copper layer having an insulating top layer and/or an insulating carrier layer. The capacitor as a second conductive layer can equally comprise a copper film or a copper layer that is provided at one side or at both sides with a top film and/or a carrier film, with at least one dielectric being introduced between the first and second conductive layers.

The dielectric introduced between the first and second conductive layers can be formed by the top layer and/or by a carrier layer of the first and/or second electrically conductive layer(s). The dielectric can, however, also be formed by an adhesive layer or by an additional dielectric layer that is introduced between the antenna element and the folded over part of the capacitor.

In accordance with an advantageous embodiment, only a part of the second conductive layer can be folded onto the antenna element so that two conductive layers are present that are separated from one another by the dielectric and that form the capacitor.

In accordance with a further advantageous embodiment, the folded over part of the second conductive layer can form a bridge between the antenna element and a feed point of the film antenna; that is the second conductive layer is not connected to the antenna element before the folding over, but is rather spaced apart therefrom.

In accordance with a further advantageous embodiment, the inductor can be formed by a loop connected in one piece to the antenna element, which permits a particularly inexpensive manufacture.

In accordance with a further advantageous embodiment, the film antenna can have two antenna elements connected to one another in one piece via the inductor to form a dipole antenna, for example. The capacitor and the inductor can here be arranged between the two antenna elements in a plan view, which in turn promotes a compact design. It is, however, also possible to form a monopole antenna in that a dipole branch or one of the antenna elements is configured as a ground plane or as a ground surface. The inductor can then be contacted at one side to this ground plane.

In accordance with a further aspect, the prevent invention also relates to a method of manufacturing a film antenna of the above-described kind. This method can comprise the steps that at least one antenna element having an electrically conductive layer is provided, with a second conductive layer being provided and a part section of the second conductive layer being folded over onto itself and onto the antenna element along a fold line. A dielectric is additionally provided between the first and second electrical conductive layers to form a capacitor and an inductor connected in one piece to the first and/or second electrically conductive layer(s) is provided.

The inductor can here be formed by a loop connected in one piece to the antenna element. In accordance with a further advantageous embodiment, the at least one antenna element, the capacitor, and the inductor can be formed from a total of exactly two blanks that are separate from one another and that are, for example, cut out or stamped out from one and the same base material.

Figure 2A:
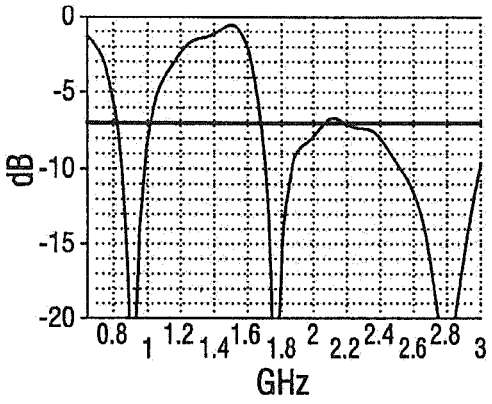
Figure 2B:
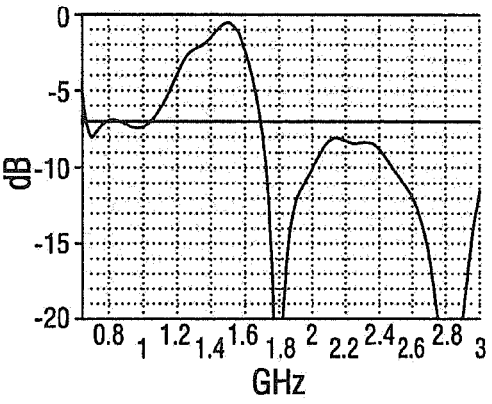
Figure 3:
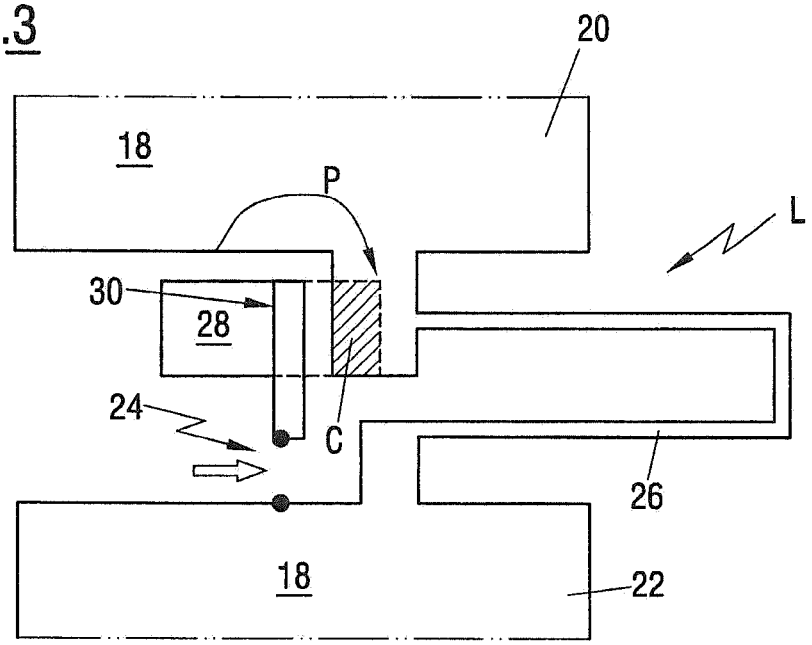
Figure 4:
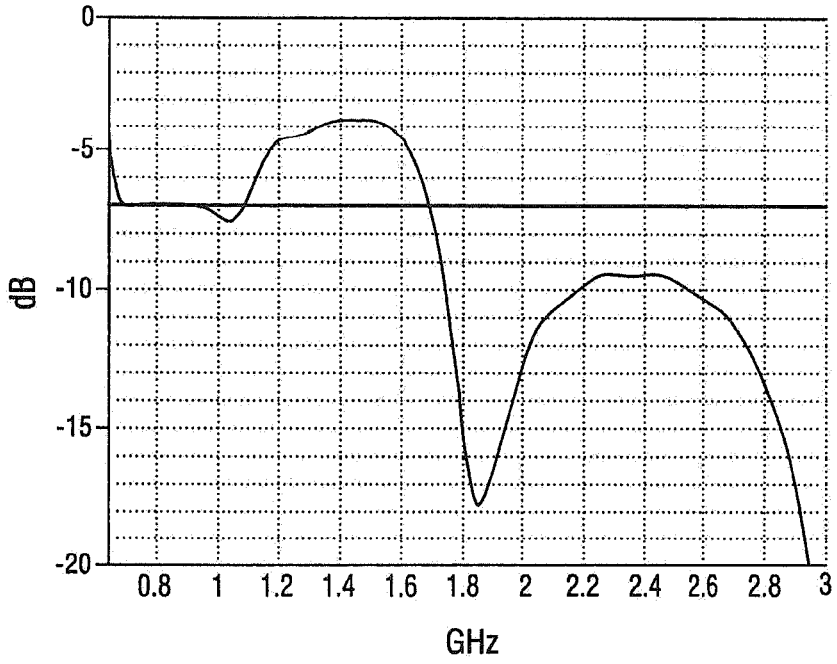

The present invention will be described in the following purely by way of example with reference to advantageous embodiments and to the enclosed drawings. There are shown:

FIG. 1 a plan view of a film antenna having a conventional adaptation network having discrete components;

FIG. 2A the reflection of the antenna of FIG. 1 at the feed point without an adaptation network;

FIG. 2B the reflection of the antenna of FIG. 1 with an adaptation network;

FIG. 3 a part view of a film antenna in accordance with the invention before the folding over of the second conductive layer; and FIG. 4 the reflection of the antenna of FIG. 3 at the feed point after the folding over and the forming of the capacitor.

FIG. 1 shows the basic structure of a dipole antenna for LTE applications. This dipole antenna comprises a first antenna element 10 and an antenna element 12 that are each manufactured from a conductive layer in the form of a copper film that is applied to a carrier film and is provided with an insulating top film. An inductor L is provided between the two antenna elements and a capacitor C is connected between a feed point 14 and the antenna element 10, with L and C being formed as discrete components and forming an adaptation network for the lower LTE frequency range of 698 to 960 MHz. The frequency range of 1.71 to 2.69 GHz likewise to be covered for today's LTE applications is already sufficiently well adapted by the configuration of the antenna structure.

The adaptation network typically comprises at least one L and one C. Both the L and the C can be arranged in series, in parallel, or also as a resonant circuit in the signal path. The example shown comprises, viewed from the antenna, a parallel L and a serial C. The result of the adaptation network having discrete components (FIG. 1) is shown as an adaptation progression comparison in comparison with the same antenna without an adaptation network in FIGS. 2A and 2B.

It can be seen that the bandwidth is considerably increased in the lower band due to the adaptation network (when a minimum adaptation of S11 <–7 dB is required as the criterion (black line). Without an adaptation network, a bandwidth of approximately 200 MHz is reached in the lower band with respect to this criterion. The bandwidth is approximately doubled. With an adaptation network. This documents the advantage of the bandwidth increase by the adaptation network.

The adaptation network requires the mounting with two discrete adaptation components. In accordance with the invention, the discrete adaptation components are replaced with film structures, as is shown in FIG. 3 that represents an enlarged representation of the feed region of the antenna.

The antenna shown in FIG. 3 comprises a first antenna element 20 and a second antenna element 22 that are both structured as described above and of which only the respective feed region is shown enlarged. An adaptation network is again provided between the two antenna elements 20 and 22 that comprises an inductor L and a capacitor C. In this respect the inductor L is formed by a loop 25 that connects the two antenna elements 20 and 22 to one another. The capacitor C comprises a second electrically conductive layer 18 that is electrically conductively connected to a pole of the feed point 24 and that is folded over on itself and on the first conductive layer 18 along a fold line 30 in the direction of the arrow P, which is shown dashed in FIG. 3. The first conductive layer 18 and the second conductive layer 28 are thus disposed above one another in the region shown hatched in FIG. 3 and are separated from one another by a dielectric introduced therebetween, whereby the capacitor C is formed.

As FIG. 3 illustrates, the folded over part of the second conductive layer 28 forms a bridge between the antenna element 18 and the feed point 24 of the film antenna in the folded over state.

To manufacture the above-described exemplary film antenna, the unit of the first antenna element 20, of the loop 26, and of the second antenna element 22 is first cut out or stamped out from a base material that comprises the first electrically conductive layer 18 and optionally comprises an electrical top layer and/or carrier layer. The second electrically conductive layer 28 is cut out or stamped out from the same material or also from a different material. The two blanks are subsequently arranged as shown in FIG. 3 and a part section of the second electrically conductive layer is folded over on itself and on the antenna element 20 along the fold line 30, with a dielectric being provided between the first and second electrically conductive layers 18 and 28 to form the capacitor C. As already mentioned, the dielectric can be formed by a top layer, by a carrier layer, by an adhesive layer, or by a separate dielectric layer.

FIG. 3 here illustrates that only exactly two blanks that are separated from one another are required to manufacture the antenna, namely the first blank comprising the components 20, 26, and 22 and the second blank comprising the second conductive layer 28. Two electrically conductive surfaces move over one another spaced apart by a dielectric by folding over the part section along the fold line 30 in the direction of the arrow P, which represents a parallel plate capacitor, with the top film layers of the two blanks being able to serve as the dielectric. Since the surface of this capacitor is settable via the layer height of the dielectric and the surface of the capacitor, almost any desired values can be achieved and set for this capacitor.

FIG. 4 shows a measurement comparable with FIG. 2B with the antenna in accordance with the invention of FIG. 3 in which the adaptation network is formed solely by means of film structures. FIG. 4 here illustrates that a very good bandwidth increase of the antenna can be reached with the implementation in accordance with the invention of the adaptation by means of film structures. The above-named advantages of the adaptation network (bandwidth increase or reduction of the antenna size, etc.) can thus also be achieved without the requirement of a mounting of discrete components on the film.

The invention claimed is:

1. A film antenna comprising:

at least one antenna element having a first electrically conductive layer; and an adaptation network comprising at least one inductor and one capacitor, wherein the capacitor comprises a second electrically conductive layer that is folded over on itself along a fold line; and wherein at least one dielectric is introduced between the first and second electrically conductive layers.

2. The film antenna in accordance with claim 1, wherein the film antenna is for LTE applications in motor vehicles.

3. The film antenna in accordance with claim 1, wherein a part of the second electrically conductive layer is folded onto the antenna element.

4. The film antenna in accordance with claim 1, wherein the folded over part of the second electrically conductive layer forms a bridge between the antenna element and a feed point of the film antenna.

5. The film antenna in accordance with claim 1, wherein the inductor is formed by a loop connected in one piece to the antenna element.

6. The film antenna in accordance with claim 1, wherein it has two antenna elements connected to one another via the inductor.

7. The film antenna in accordance with claim 6, wherein two antenna elements are connected to one another in one piece via the inductor.

8. The film antenna in accordance with claim 1, wherein it is configured as a monopole antenna and has two antenna elements that are connected to one another, with one of the antenna elements being formed as a ground plane.

9. The film antenna in accordance with claim 1, wherein the inductor is contacted on the ground plane.

10. The film antenna in accordance with claim 1, wherein it has two antenna elements that are connected to one another in one piece; and wherein the capacitor and the inductor are arranged between the two antenna elements in a plan view.

11. The film antenna in accordance with claim 1, wherein the dielectric comprises at least one of a top layer, a carrier layer of the first electrically conductive layer and a carrier layer of the second electrically conductive layer.

12. The film antenna in accordance with claim 1, wherein the dielectric comprises at least one of an adhesive layer and a separate film.

13. A method of manufacturing a film antenna comprising:

at least one antenna element having a first electrically conductive layer; and an adaptation network comprising at least one inductor and one capacitor, the method comprising the following steps:

providing the at least one antenna element with the first electrically conductive layer; and providing a second electrically conductive layer;

folding over a part section of the second conductive layer on itself and on the antenna element along a fold line;

providing a dielectric between the first and second electrically conductive layers to form the capacitor; and providing the inductor connected in one piece to at least one of the first electrically conductive layer and the second electrically conductive layer.

14. The method in accordance with claim 13, wherein the inductor is formed by a loop connected in one piece to the antenna element.

15. The method in accordance with claim 13, wherein the at least one antenna element, the capacitor, and the inductor are formed from a total of exactly two blanks separated from one another.

16. The method in accordance with claim 13, wherein no discrete components are used for the formation of an adaptation network formed by the capacitor and the inductor, but only the two electrically conductive layers are used.

* * * * *